US006631567B1

(12) United States Patent
Have

(10) Patent No.: US 6,631,567 B1
(45) Date of Patent: Oct. 14, 2003

(54) APPARATUS FOR REMOVING A FLUID COMPONENT FROM PARTICULIZED SOLID MATERIALS

(75) Inventor: Sander ten Have, Vlaasrdingen (NL)

(73) Assignee: Unilever Patent Holdings BV, Vlaardingen (NL)

( * ) Notice: Subject to any disclaimer, the term of this patent is extended or adjusted under 35 U.S.C. 154(b) by 15 days.

(21) Appl. No.: 10/049,657

(22) PCT Filed: Jul. 11, 2000

(86) PCT No.: PCT/EP00/06593

§ 371 (c)(1),
(2), (4) Date: Feb. 15, 2002

(87) PCT Pub. No.: WO01/12287

PCT Pub. Date: Feb. 22, 2001

(30) Foreign Application Priority Data

Aug. 17, 1999 (EP) ..... 99202665

(51) Int. Cl.[7] ..... F26B 21/06; F26B 17/00

(52) U.S. Cl. ..... 34/476; 34/72; 34/218; 34/509; 34/582; 34/583; 34/654

(58) Field of Search ..... 34/72, 218, 476, 34/443, 446, 460, 509, 576, 582, 583, 639, 654

(56) References Cited

U.S. PATENT DOCUMENTS

| | | | | |
|---|---|---|---|---|
| 2,634,511 A | | 4/1953 | Underwood et al. | |
| 3,277,582 A | * | 10/1966 | Munro et al. | 34/57 |
| 3,386,182 A | | 6/1968 | Lippert et al. | |
| 3,544,089 A | | 12/1970 | Ledent | 263/21 |
| 3,595,541 A | | 7/1971 | Pabich | 263/21 A |
| 3,605,275 A | * | 9/1971 | Enders | 34/57 A |
| 3,733,056 A | * | 5/1973 | Fong | 259/4 |
| 3,908,045 A | | 9/1975 | Alterman et al. | |
| 4,023,280 A | | 5/1977 | Schora et al. | |
| 4,033,555 A | | 7/1977 | Fong | 259/4 R |
| 4,135,889 A | * | 1/1979 | Mori | 48/73 |
| 4,416,857 A | * | 11/1983 | Vorres | 422/145 |
| 4,439,933 A | * | 4/1984 | Dietrich et al. | 34/65 |
| 4,532,155 A | | 7/1985 | Golant et al. | 427/213 |
| 4,640,023 A | | 2/1987 | Mori et al. | |
| 4,650,681 A | | 3/1987 | Greethead | 426/19 |
| 4,866,858 A | | 9/1989 | Delano | 34/10 |
| 4,875,435 A | | 10/1989 | Jan et al. | 118/62 |
| 4,949,735 A | * | 8/1990 | Clift et al. | 131/291 |
| 5,067,252 A | * | 11/1991 | Baillie | 34/57 A |
| 5,082,634 A | * | 1/1992 | Raufast | 422/143 |
| 5,085,170 A | * | 2/1992 | Huttlin | 118/303 |
| 5,185,171 A | * | 2/1993 | Bersten | 426/467 |
| 5,333,392 A | * | 8/1994 | Heinze | 34/363 |
| 5,647,142 A | | 7/1997 | Andersen et al. | |
| 5,839,207 A | * | 11/1998 | Christensen et al. | 34/369 |
| 6,098,905 A | | 8/2000 | Salem et al. | 241/3 |

FOREIGN PATENT DOCUMENTS

| | | |
|---|---|---|
| DE | 23 15 879 | 10/1973 |
| DE | 25 55 917 | 11/1976 |
| DE | 29 12 579 | 1/1980 |
| FR | 1401570 | 10/1965 |
| FR | 1171667 | 9/1973 |
| GB | 2324744 | 11/1998 |
| JP | 54940480 | 10/1980 |

* cited by examiner

*Primary Examiner*—Denise L. Esquivel
*Assistant Examiner*—K. B. Rinehart
(74) *Attorney, Agent, or Firm*—Morgan, Lewis & Bockius LLP

(57) ABSTRACT

The invention concerns an apparatus for the removal of moisture from particulized, solid food products, comprising; a housing (9); a perforated plate (2), creating two chambers (3, 4) in the housing (1), gas-inlets (5, 6), present below the perforated plate (2); an outlet (8) in the perforated plate (2), provided with a removable plug (9); heating means (15, 18) for the gases. The invention further concerns a process for the removal of moisture from solid, small particles, by subjecting these particles, while in an annular, fluidized bed to a heat treatment for a specific time.

24 Claims, 1 Drawing Sheet

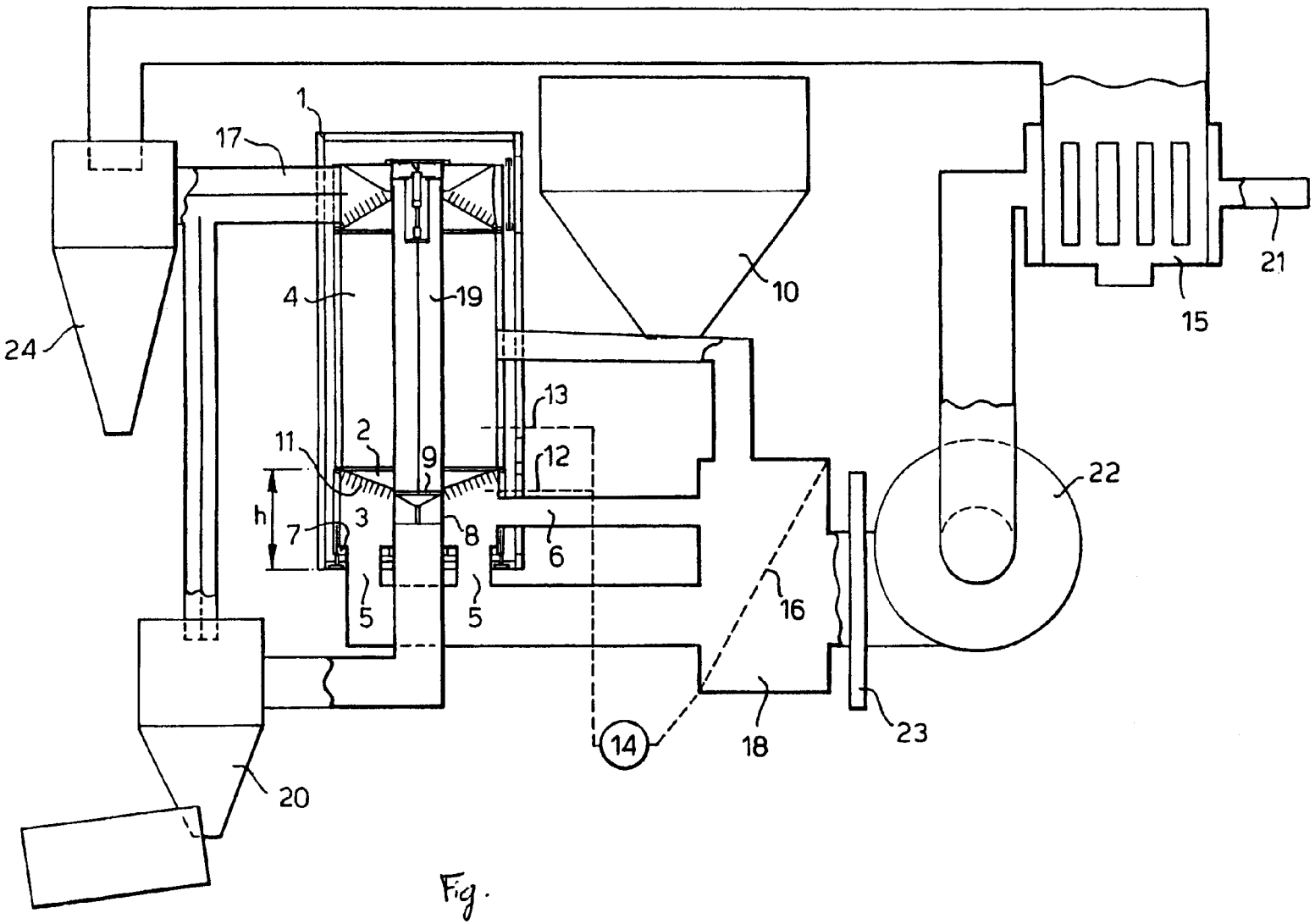
Fig.

APPARATUS FOR REMOVING A FLUID COMPONENT FROM PARTICULIZED SOLID MATERIALS

The invention concerns apparatus for the removal of a fluid component, in particular of moisture from particulized solid materials, in particular from solid particulized food materials. The invention further concerns a process for the removal of these fluids from those materials, in particular by using the apparatus according to the invention.

An apparatus for the conditioning of particulate or granular materials in a fluidized bed is disclosed in U.S. Pat. No. 4,033,555. According to this document moisture can be removed from materials such as a sand by providing a fluidized bed of the sand and subjecting the sand to an air stream with a predetermined flow pattern for circulating and mixing the material. The apparatus disclosed has a sieve plate provided with openings with a specific shape through which the fluidizing gas is introduced in the apparatus. These openings stimulate the circulation and create controlled sprouting of the material in the vicinity of the walls and in this way an internal circulation of the material in the fluid bed is achieved, which prevents the granular material from sticking together. This makes that this system can also be applied for non free flowing granular materials such as eg wet sand. This apparatus however is not useful for removing moisture from particulized solid food materials because these materials can be damaged easily during the treatment leading to the appearance of black spots due to overburning. Moreover this apparatus cannot be used in a semi-continuous process as no provisions are given for the removal of the treated material. Also the heating of the gas is not efficient as no indications are given how the fluidizing gases are heated and/or how the rest heat present in the exhaust gases can be applied in the process. Further the introduction of the fluidizing gases via the bottom of the sieve plate is not very efficient because these gases do not have a clear axial and tangential component. Herefore the openings in the sieve plate have to have a very specific shape.

From U.S. Pat. No. 4,875,435 an apparatus is known that can be applied for the combined drying and coating of pharmaceutical materials. Herefore the apparatus according to this US patent is provided with spraying means for the coating. Although a fluidized bed is created above a sieve plate and gases are introduced that provide an axial component to the solid materials in the fluidized bed, the gas that provides the tangential component to these materials is introduced above the sieve plate. We found that such an introduction of the latter gas does not lead to good results. Moreover the system disclosed herein has other disadvantages such as the fact that in the treatment chamber above the sieve plate areas are present wherein the fluidisation is not optimal, which leads to non-hygenical conditions that are not allowable in the treatment of food products. Also hot spots will be present leading to local overburning of the food products and thus resulting in unacceptable products. Further the products cannot be removed from the system in a way enabling a semi-continuous process.

A similar apparatus is disclosed in U.S. Pat. No. 4,532,155. Therefore the same disadvantages are connected to the use of this apparatus as mentioned above.

According to U.S. Pat. No. 3,908,045 an apparatus for the coating of detergent particles is provided with a perforated plate through which fluidizing gas is introduced so that a fluidizable substance is coated in a fluidized bed. Although air is introduced that provides a tangential component to the particles it is not clear whether this air is introduced above or below the perforated plate.

According to U.S. Pat. No. 4,866,858 or JP 54040480 the heat transfer in a fluidized bed can be improved if the fluidizing gas is introduced as sequential streams (thus creating a kind of pulsated gas stream).

The use of a centrally positioned opening for the removal of the reaction product from a fluidized bed system is disclosed in eg U.S. Pat. No. 4,640,023.

We studied whether we could develop a novel apparatus and find a novel process which would enable us to remove a fluid component, in particular moisture from particulized material, in particular particulized food products which would avoid the problems of the prior art mentioned above. This study resulted in our new inventions on an appartus and on a process. Therefore our invention concerns in the first instance a novel apparatus for the removal of a fluid component from particulized solid materials comprising;

- a housing (1)
- a perforated plate (2) separating the housing (1) into two chambers (3) and (4),chamber (3) being a gas introduction chamber and chamber (4) being a reaction/drying chamber, whereby:
  - chamber (3) is provided with two separated gas inlets (5) and (6)
  - gas inlet (5) being present in the bottom (7) of chamber (3) and providing an axial direction to the gas and
  - gas inlet (6) being present below the plate (2) and providing a tangential direction component to the gas
  - the perforated plate (2) is provided with an outlet opening (8), provided with a removable plug (9) for opening and closing of outlet opening (8)
  - means (10) for feeding the solid particulized material into chamber (4)
  - a gas outlet system (17) for the removal of the gases from chamber (4)

In order to achieve that an efficient fluidisation of the particulized material is obtained, wherein the particles obtain an axial and a tangential velocity component, while simultaneously the particulized material remains above the perforated plate (2) during the processing, we found that it is best if the perforated plate (2) is provided with perforations (11) with a diameter between 0.5 and 4 mm. Optimal results being obtained if the total surface of the perforations in plate (2) is 10–30%, preferably 15–25% of the total plate surface.

In order to achieve that the fluidized bed will obtain the form of an annular bed of fluidized particles while the removal of the end product is facilitated we found that it is beneficial if plate (2) has a shape of a cone or a wok, while at the lowest point of the cone or wok outlet opening (8) is present.

The thickness of the plate (2) and the size of the perforations herein have an impact on the velocity of the tangentially introduced gas component and thus on the creation of the fluidized bed. Therefore we prefer to apply a plate wherein the ratio between thickness (t) of plate (2) and diameter (d) of the perforations (11) in plate (2), i.e. t/d= 0.2–1.6.

The position for the inlet of the gas introduced via gas inlet (6) has an impact on the efficiency of creating the fluidized bed. We found that the best results were obtained if gas inlet (6) is present at a point above 0.4 h, preferably at a point above 0.5 h from the bottom of housing (1), h being the height of chamber (3).

In order to control the temperature in the reaction chamber (4) we apply a heat sensor (12) in chamber (3) and preferably also a heat sensor (13) in chamber (4). The heat sensor(s) produce a signal that is applied to control the temperature of the gas streams in inlets (5) and (6) through regulating means (14) for regulating the heating of these gas streams.

A device that can be used to obtain an efficient heat transfer in the fluidized bed is a pulsator, preferably placed in the gas stream introduced via inlet (6). Herewith the velocity of this gas stream can be pulsated, resulting in a fluidized bed wherein the distance between the individual particles can be changed during the processing. This pulsating preferably is performed with an amplitude between 0.25 and 10 Hertz.

In order to enable a semi-continuous process we found that the provision of an outlet opening (8) in plate (2) led to very suitable results. Therefore we prefer to use an apparatus wherein a plug (9) is attached to a plunger (19), which plug (9) corresponds with the shape and size of outlet opening (8) in plate (2), which outlet opening has a diameter of 100–200 mm.

For an efficient energy consumption we found that it is advantageous if in the gas outlet system (17) leaving chamber (4) an indirect heat exchanger (15) is present, whereas the gas in outlet (17) is in indirect heat exchange with the fresh gas (21) introduced in the system via inlets (5) and/or (6). The gas leaving heat exchanger (15) can be split into two stream by using a valve (16) in heat exchanger (15), whereby the two gas streams are introduced into the system via inlets (5) and (6). The ratio wherein the gas streams are introduced via (5) and (6) can be controlled by the position of valve (16).

The invention also concerns a process for the removal of a fluid component from particulized solid material in a reactor, wherein the solid particulized material is fluidized by a preheated gas providing to the solid particles an axial velocity component and a preheated gas providing to the solid particles a tangential velocity component in such a way that during the heat treatment the solid particles form a fluidized, annular bed of particles, at a temperature and for a time sufficient to remove the fluid component without overburning of the solid particulized material, whereupon the treated solid particulized material is separated from the reactor as end product, while thereafter fresh solid particulized material, from which the fluid component still must be removed, is introduced in the reactor.

The best results were obtained when the gas providing the tangential velocity component is introduced in the reactor below a perforated plate that forms a barrier between an introduction chamber for the treatment gases and a reaction chamber.

Gas velocities that can be applied for the fluidizing gas can range from more than 0.5 m/sec, preferably more than 1.5 m/sec to less than 50 m/sec, preferably less than 10 m/sec. The best results being obtained when the gases that provide the axial velocity component and the tangential component are introduced in the introduction chamber in a ratio $V_{ax}:V_{tang}$=0.1 to 10, $V_{ax}$ being the velocity of the gas providing the axial component and $V_{tang}$ being the velocity of the gas providing the tangential component. The gases should be introduced in the reactor with such a velocity that the solid particulized material that is introduced above the perforated plate remains above the perforated plate in the form of an annular fluidized bed of solid particles.

The temperature that can be applied in the reaction chamber (4) should be controlled carefully within a specific range, this can be achieved by introducing the gases into the reactor directly under the perforated plate (2) with a temperature within the range of 180–350° C., preferably 200–300° C.

The most efficient energy consumption is achieved if the temperature of the gases that are introduced in the reactor is controlled by a the signal from a temperature sensor in the introduction chamber of the reactor which signal is fed to an indirect heat exchanger wherein fresh introduction gas is in indirect heat exchange with gas removed from the reactor. If a signal from a second heat sensor, but now present in the reaction chamber is used as well for this control an even more efficient temperature control is possible.

The residence time of the particulized material in the reactor can range effectively between 15 and 90 sec, preferably between 20 and 60 sec.

Although we can subject all kinds of particulized food products to the treatment according to the invention in particular using the apparatus according to the invention we found that very good and unexpected results were obtained if the food material is grained rice and the fluid component removed herefrom is water. The gas stream can be selected from all inert, food grade gases but we prefer to apply air or nitrogen as gas herefore.

In the drawing attached the apparatus according to the invention is schematically set out. As illustration of the apparatus and the process of the invention the drawing and the use of the apparatus according to this drawing will be discussed into more detail.

Material to be dried, such as grained rice is fed from a hopper (10) into the reaction chamber (4) from a reactor comprising a housing (1) provided with a perforated plate (2) with the shape of a wok and provided with perforations (11) with a size of about 2 mm and dividing housing (1) into a gas introduction chamber (3) and a reaction/drying chamber (4). A fluidizing gas is introduced with a velocity of 15 m/sec via gas inlets (5) in bottom (7) into chamber (3). This gas stream gives the particles in chamber (4) an axial component. Simultaneously a gas is introduced with a velocity of 35 m/sec via gas inlets (6), directly below the plate (2). This gas gives a tangential component to the solid particles in chamber (4). In this way the solid particulized material forms an annular fluidized bed in chamber (4). The gases introduced via inlets (5) and (6) are heated in heater (18) after being preheated in indirect heat exchange in heat exchanger (15) with the gases leaving the system via outlet (17). The temperature of the gases introduced via (5) and (6) is controlled by heat sensors (12) and (13) present in chambers (3) and (4) respectively. The heat sensors produce a signal which is fed to heat regulating means (14) connected with heater (18) and valve (16) therein. In order to be able to interrupt the processing and to remove dried product from the reactor an opening (8) is present in the plate (2), which opening (8) is provided with a plug (9) corresponding in shape and size with opening (8) and which plug is closing opening (8) during the drying process but can be lifted using a plunger (19) after interrupting the gas supply to the system. The dried product is removed via a duct which is connected with a separator (20) wherein the product is cooled and separated from excess gas. The exhaust gases leaving the system via outlet (17) are led to a separator (24), preferably being a cyclone, wherein the dust and the gas are separated, whereupon the gases are led to heat exchanger (15) to which also fresh gas is led via inlet (21). A fan (22) is used for the transport of the gas. Valve (16) is used for the division of the gas from fan (22) into two streams (5) and (6) in the desired ratio.

What is claimed is:

1. Apparatus for the removal of a fluid component from particulized solid materials comprising:

a housing (1)

a perforated plate (2) separating the housing (1) into two chambers, a first chamber (3) and a second chamber (4), the first chamber (3) being a gas introduction chamber and the second chamber (4) being a reaction/drying chamber, whereby:

the first chamber (3) is provided with two separated gas inlets which are a first inlet (5) and a second inlet (6)

the first gas inlet (5) being present in a bottom (7) of the first chamber and providing an axial direction to the gas and the second gas inlet (6) being present below the plate (2) and providing a tangential direction component to the gas the perforated plate (2) is provided with an outlet opening (8) which is provided with a removable plug (9) for the opening and closing of the outlet opening (8)

mean (10) for feeding the solid particulized material into the second chamber (4)

a gas outlet system (17) for the removal of the gases from the second chamber heating means (15, 18) for the heating of the gases introduced via the first gas inlet (5) and the second gas inlet (6).

2. Apparatus according to claim 1 wherein the perforated plate (2) is provided with perforations (11) with a diameter between 0.5 and 4 mm.

3. Apparatus according to claims 1 or 2, wherein the total surface of the perforations in the plate (2) is 10–30% of the total plate surface.

4. Apparatus according to claim 1, wherein plate (2) has a shape of a wok, while at the lowest point of the wok, an outlet opening (8) is present.

5. Apparatus according to claim 1, wherein the ratio between a thickness (t) of plate (2) and a diameter (d) of the perforations (11) in plate (2), i.e. t/d=0.2–1.6.

6. Apparatus according to claim 1, wherein gas inlet (6) is present at a point above 0.4 h from the bottom of housing (1), h being the height of the first chamber (3).

7. Apparatus according to claim 1, wherein a heat sensor (12) is present in the first chamber (3).

8. Apparatus according to claim 7, wherein in the second chamber (4) also a heat sensor (13) is present.

9. Apparatus according to claim 7, wherein heat sensor (12) or heat sensor (12) and a heat sensor (13) of the second chamber are connected with regulating means (14) for regulating the heating of the gas streams for the first gas inlet (5) and the second gas inlet (6).

10. Apparatus according to claim 1, wherein gas inlet (6) is provided with means for pulsating the gas stream via inlet (6).

11. Apparatus according to claim 1, wherein the plug (9) is attached to a plunger (19), while plug (9) corresponds with the shape and size of outlet opening (8) in plate (2), which outlet opening has a diameter of 100–200 mm.

12. Apparatus according to claim 1, wherein in the gas outlet system (17) leaving the second chamber (4) an indirect heat exchanger (15) is present, whereas the gas in outlet (17) is in indirect heat exchange with fresh gas (21) introduced in the system via the first gas inlet (5) and/or the second gas inlet (6).

13. Apparatus according to claim 1, wherein in the gas system, leaving heat exchanger (15) a valve (16) is present for dividing the introduction gas over the first gas inlet (5) and the second gas inlet (6).

14. Process for the removal of a fluid component from particulized solid material in a reactor by treatment gases having two components, wherein the solid particulized material is fluidized by a preheated gas providing to the solid particles an axial velocity component and a preheated gas providing to the solid particles a tangential velocity component, which is introduced in the reactor below a perforated plate that forms a barrier between an introduction chamber for the treatment gases and a reaction chamber in such a way that during the heat treatment the solid particles form a fluidized, annular bed of particles, at a temperature and for a time sufficient to remove the fluid component without overburning of the solid particulized material, whereupon the treated solid particulized material is separated from the reactor as end product, while thereafter fresh solid particulized material, from which the fluid component still must be removed, is introduced in the reactor.

15. Process according to claim 14, wherein the gas providing the tangential velocity component is introduced in the reactor below a perforated plate that forms a barrier between an introduction chamber for the treatment gases and a reaction chamber.

16. Process according to claim 14, wherein the gases are introduced in the reactor with such a velocity that the solid particulized material that is introduced above the perforated plate remains above the perforated plate in the form of an annular fluidized bed of solid particles.

17. Process according to claim 14, wherein the temperature of the gases introduced in the reactor ranges between 180 and 350° C. at a point directly under the perforated plate.

18. Process according to claim 14, wherein the temperature of the gases that are introduced in the reactor is controlled by a the signal from a temperature sensor in an introduction chamber of the reactor which signal is fed to an indirect heat exchanger wherein fresh introduction gas is in indirect heat exchange with gas removed from the reactor.

19. Process according to claim 14, wherein the residence time of the particulized material in the reactor ranges from 15 to 90 sec.

20. Process according to claim 14, wherein the treatment chamber of the reactor is provided with a plunger provided with a plug, corresponding in size and shape with an opening in a low part of the perforated plate, which plunger is lifted after the treatment of a batch of particulized solid material is finished whereupon the treated end product is removed from the reaction chamber, using overpressure within this chamber.

21. Process according to claim 14 wherein the gas providing the tangential velocity component to the solid particles is introduced in the reactor while pulsating with an amplitude of 0.25 to 10 Hertz.

22. Process according to claim 14 wherein the particulized solid material is a food product, and the fluid component to be removed herefrom is water.

23. Process according to claim 14 wherein the gas applied is an inert gas.

24. Process according to claim 22 wherein the food product is grained rice.

* * * * *